US007178598B2

(12) United States Patent
Lund et al.

(10) Patent No.: US 7,178,598 B2
(45) Date of Patent: Feb. 20, 2007

(54) DEVICE FOR A HYDRAULIC CUTTING TOOL

(75) Inventors: Per Lund, Vestre Amoy (NO); Erling J. Wiig, Oslo (NO)

(73) Assignee: Norse Cutting & Abandonment A. S., Tananager (NO)

( * ) Notice: Subject to any disclaimer, the term of this patent is extended or adjusted under 35 U.S.C. 154(b) by 249 days.

(21) Appl. No.: 10/517,239

(22) PCT Filed: Jun. 4, 2003

(86) PCT No.: PCT/NO03/00178

§ 371 (c)(1),
(2), (4) Date: Dec. 3, 2004

(87) PCT Pub. No.: WO03/104608

PCT Pub. Date: Dec. 18, 2003

(65) Prior Publication Data

US 2005/0173123 A1 Aug. 11, 2005

(30) Foreign Application Priority Data

Jun. 6, 2002 (NO) ..... 20022668

(51) Int. Cl.
*E21B 29/12* (2006.01)
*E21B 7/12* (2006.01)

(52) U.S. Cl. ..... 166/298; 166/361; 166/55.7; 299/17; 451/38

(58) Field of Classification Search ..... 166/361, 166/173, 298, 55, 55.1, 55.2, 55.6, 55.7, 166/55.8; 299/17; 451/38
See application file for complete search history.

(56) References Cited

U.S. PATENT DOCUMENTS 4,598,769 A * 7/1986 Robertson ..... 166/55
5,010,694 A * 4/1991 Agbede ..... 451/38
5,381,631 A 1/1995 Raghavan et al.
5,435,394 A * 7/1995 Robertson ..... 166/382

(Continued)

FOREIGN PATENT DOCUMENTS

GB 2 236 065 3/1991

(Continued)

*Primary Examiner*—Thomas A. Beach
(74) *Attorney, Agent, or Firm*—Knobbe Martens Olson & Bear LLP

(57) ABSTRACT

A device for a hydraulic cutting tool (30) for cutting of at least one pipe (16, 18, 20) or tubular object beneath a water floor (10), wherein the cutting is carried out from a surface facility (2). The cutting tool (30) is anchored in a pressure tight manner in the pipe (16), whereupon pressurised gas (86) is pumped into a pipe section (80) immediately below the cutting tool (30). With this, liquid (8), and eventually pressurised gas (86), will flow out of the pipe section (80) via a short drain pipe (66) through the cutting tool (30), so as to create a gas filled pipe volume (90) comprising the relevant cutting depth (32) in the pipe section (80). The invention differs from prior art by the outflowing liquid being led onwards up to the surface facility (2) via a drain line (92). The upper end portion of the drain line (92) is connected to at least one adjustable choke device (102, 104). This allows the gas overpressure in said pipe volume (90) to be controlled during the cutting, providing optimal operating conditions during the hydraulic cutting.

9 Claims, 2 Drawing Sheets

U.S. PATENT DOCUMENTS 5,695,010 A * 12/1997 Hongo ..... 166/301
6,138,777 A * 10/2000 Fraim et al. ..... 175/92
6,155,343 A 12/2000 Nazzal et al.
6,439,313 B1 * 8/2002 Thomeer et al. ..... 166/361
6,564,868 B1 * 5/2003 Ferguson et al. ..... 166/298
2004/0089450 A1 * 5/2004 Slade et al. ..... 166/298

FOREIGN PATENT DOCUMENTS

GB 2 288 350 10/1995
WO WO 02/32634 4/2002

* cited by examiner

DEVICE FOR A HYDRAULIC CUTTING TOOL

BACKGROUND OF INVENTION

1. Field of Invention

This invention regards a device for a hydraulic cutting tool for cutting of tubular objects beneath a water floor, e.g. beneath a seafloor.

The device is preferably used for cutting of casings in connection with the permanent plugging and abandonment of a well drilled under water, e.g. a petroleum well. After cutting, the cut-off pieces of casing may be removed from the water floor. Such a well may be completed at the water floor or above water, e.g. on a platform or another type of surface facility. In the latter case the well is connected to the surface facility via a riser. On the other hand, both types of wells are drilled under water and down into a water floor, and such a well is hereinafter termed an offshore well.

Said device may also be used in connection with the cutting of other types of tubular objects disposed in a water floor. Such an object may comprise a tubular pile or a caisson. As an example, tubular piles are used to anchor platforms and other offshore structures to a water floor. In this case, the piles are driven into the water floor, then to be fixed to appropriate fixing devices such as fixing brackets on the offshore structure in question.

2. Description of the Related Art

The invention is based on the cutting of casings, in particular compound casings, beneath a water floor upon abandonment of offshore wells. When cutting beneath a water floor, access from the outside of the pipes is impossible, making it necessary to perform the cutting from inside the casing. In this connection, known cutting devices and cutting methods are encumbered with a number of disadvantages and problems.

Cutting of said tubular objects under a water floor, including casings, piles and caissons, is normally carried out mechanically, hydraulically or through blasting.

As the invention comprises a hydraulic cutting tool that is known per se, and which is typically used for cutting of casings in an offshore well, the following discussion will only concern hydraulic cutting of casings according to prior art. This discussion also concerns those disadvantages of known hydraulic cutting techniques which the present invention seeks to remedy. This is also necessary in order to understand significant characteristics of the invention, as well as the problems which the invention seeks to remedy.

A well is normally composed of several casing strings arranged inside each other with decreasing diameters, where each smaller casing string extends deeper into the ground than the previous and larger casing string. In addition, one or more annuli between the casing strings may be completely or partially filled with set cement. Such casing strings are hereinafter only termed casings.

The cutting of casings beneath a water floor is carried out by means of a hydraulic cutting tool which is lowered into the well from a surface facility such as a platform, the cutting tool being lowered to the relevant cutting position in the innermost casing of the well. The cutting tool is equipped with a high pressure nozzle through which a concentrated jet of fluid exits at high speed, cutting through the casing and any annular cement. The exiting high speed jet normally has a diameter of 1–2 mm and is delivered at a very high pressure, for example 1000 bar. The cutting jet consists of a fluid, preferably water, mixed with an abrasive. The cutting fluid is hereinafter termed an abrasive fluid. According to prior art, such hydraulic cutting is carried out at water depths of up to 100 meters, and the cutting is often carried out 5 meters beneath the water floor. Moreover, the cutting method is relatively quick, requires little equipment, and may be carried out with a minimum risk of injury/damage to personnel, servicing means and any remaining downhole equipment, including well plugs that seal against any reservoir fluids.

In principle, a conventional hydraulic cutting system consists of a high pressure pump; a mixing device in which said fluid and abrasives are mixed; a cutting tool comprising among other things said high pressure nozzle, a high pressure line through which said abrasive fluid is pumped down to the cutting tool; at least one auxiliary line via which e.g. hydraulic and/or electrical driving power and/or hydraulic/electrical control and/or monitoring signals are transmitted to the cutting tool; and a hoisting device such as a wire winch for bringing the cutting tool into or out of the well. In addition, the cutting tool comprises an actuator, preferably hydraulically actuated, for fixing and possibly sealing the cutting tool in the casing in question; a rotating motor, preferably hydraulically actuated, for rotating the high pressure nozzle during the cutting; and various other known equipment such as sprockets, shafts, bearings, gears, clamping implements, gaskets, hydraulic cylinders and pistons, pipes, couplings, control units and monitoring equipment. Operation of said rotating motor and actuator depends among other things on there being auxiliary lines available through which said driving power and control and/or monitoring signals may be transmitted to the cutting tool.

From the surface facility and in the innermost casing of the well, the cutting tool, said high pressure line for abrasive fluid and said auxiliary lines are lowered to the cutting position beneath the water floor. Then the cutting tool is fixed against the wall of the casing in the working position by at least one associated hydraulically actuated and releasable anchoring device, e.g. a clamping jaw or a clamping claw. The cutting tool may also be equipped with at least one hydraulically actuated and releasable anchoring-and sealing device, e.g. at least one rubber elastic packing, which is pressed against the casing wall and separates two sections of the casing in a pressure tight manner. In the latter case, the anchoring device and the sealing device may be actuated by a common hydraulic actuator device driven and controlled by means of said auxiliary lines.

Hydraulic cutting is initiated by the abrasive fluid being pumped from said high pressure pump and down through said high pressure line to the cutting tool. The abrasive fluid is conducted further through the cutting tool to an angular and rotatable high pressure pipe, the free end of which is connected to said high pressure nozzle, the high pressure pipe and the nozzle projecting down from the cutting tool. By means of a rotating motor and suitable transmission means, said pipe and nozzle are rotated peripherally through at least one complete rotation (at least 360° angle) about the longitudinal axis of the casing. The high pressure pipe and the nozzle are rotated at an appropriate peripheral speed, and preferably in the horizontal plane, the cutting jet simultaneously cutting through one or more casings and any annular cement. In this connection at least one annulus may be completely or partially filled with set cement, liquid and/or air.

According to prior art, the hydraulic cutting is generally carried out in an environment consisting of the liquid normally present in the innermost casing, e.g. seawater. The cutting jet will therefore pass through a liquid between the nozzle outlet and the casing wall. However this results in a lot of the initial pressure energy of the cutting jet being lost through impact loss when the cutting jet collides with the liquid in the casing at high speed. In some cases the liquid filled casing is therefore arranged with a small pipe volume that is filled with air or nitrogen, the pipe volume being arranged immediately below the cutting tool and comprising the cutting site in question. Said air or nitrogen is hereinafter simply termed a gas. In principle, the cutting jet will thereby pass through gas instead of liquid, whereby said impact loss is reduced considerably. By so doing, a significantly greater share of the initial pressure energy of the cutting jet should be available for cutting the casings and any annular cement. In principle, it should then be possible to cut through pipes and any annular cement much more quickly, whereby any disruptive or damaging influential forces have considerably less time to affect the cutting result in a negative manner. Said influential forces may arise as a result of flow movements or hydrostatic pressure changes in the liquid column above the cutting tool. The influential forces may cause the cutting tool and the cutting jet exiting from it to be subjected to undesirable axial movement, which causes an undesirable reduction in cutting power and the precision of the cut. This may cause the continuity of the cutting to be interrupted and/or cause the resulting faces of the cut to form a discontinuous, e.g. helical, cut in stead of a continuous and circular cut. In both cases the cutting must be repeated. Such movement may also cause fluid leaks in the gaskets of the cutting tool, whereby seeping liquid flows into the cutting area in question, possibly reducing the impact force of the cutting jet.

In order to allow said pipe volume to be filled with said gas, the cutting tool must be connected to a compressor on the surface facility via a pressure line for gas. According to prior art, the cutting tool is also equipped with a short drain pipe running through the cutting tool. The upper end of the drain pipe is terminated immediately above the cutting tool, and the lower end of the pipe is terminated below the cutting depth in question. Moreover, the drain pipe is designed to be peripherally rotatable together with the high pressure pipe and the high pressure nozzle, to prevent the cutting jet from cutting off the drain pipe during rotation.

After the cutting tool according to prior art has been fixed in a pressure tight manner in the innermost casing of the well, pressurised gas is pumped into said pipe volume underneath the sealing means of the cutting tool via said pressure line. The gas is supplied at a pressure which is sufficient to force water in this pipe volume out through the short drain pipe in the cutting tool, to be mixed with the surrounding water immediately above the cutting tool. By so doing, the pipe volume comprising the cutting depth in question is filled with pressurised gas. During the cutting, pressurised gas is continuously pumped into this pipe volume.

Even though the known technique of hydraulic cutting in a gas filled environment is more efficient than cutting in liquid, the known technique of cutting in gas is also encumbered with considerable disadvantages. Among them is the fact that a continuous feed of pressurised gas via said small pipe volume will also entail a continuous outflow of pressurised gas at the top of said short drain pipe. Thus, gas bubbles will continuously rise and expand in the overlying liquid column of the casing. Expansion of gas bubbles in the liquid column may cause percussions or movements in the liquid column, and such influential forces may propagate downwards in the liquid column, possibly causing unwanted movement of the cutting tool during the cutting, cf. previous mention of this. Continuous outflow of gas immediately above the cutting tool also means that the gas pressure in the cutting area in question can not exceed the hydrostatic pressure at the outlet of the short drain pipe to any appreciable extent. Cutting in said gas filled volume is therefore carried out at a marginal gas overpressure. In addition, this gas overpressure will remain roughly unchanged even if the gas inflow rate to the pipe volume is increased. Instead, such an increase will cause a greater outflow of undesirable gas bubbles rising and expanding in the liquid column of the casing. In addition to these disadvantages, the marginal gas overpressure is also a considerable disadvantage to the hydraulic cutting. When the fluid jet cuts through casings and possibly annular cement, the marginal gas overpressure will be insufficient to prevent hydrostatically pressured liquid from the outside of the casing/casings from trickling into the gas filled casing volume via one or more cuts in said casing. Thus the cutting jet will collide with inflowing liquid, causing an impact loss to the cutting jet, which reduces the impact force of the cutting jet. This reduction in the inherent energy of the cutting jet is particularly disadvantageous when cutting through several consecutive casing sizes, as this loss of energy reduces the ability of the cutting jet to cut efficiently through all the casings and any associated annular cement.

SUMMARY OF THE INVENTION

The object of the present invention is to remedy the above disadvantages connected with known hydraulic cutting techniques for cutting of tubular objects beneath a water floor. Such tubular objects consist of e.g. casings, piles or caissons, such tubular objects hereinafter simply being termed pipes. In particular, the invention seeks to remedy the disadvantages connected with hydraulic cutting in an air or nitrogen filled pipe volume having a marginal gas overpressure with respect to the surrounding hydrostatic pressure.

The object is achieved by the characteristics given in the following description and in the appended claims.

The present invention comprises among other things the use of a known hydraulic cutting system connected to a surface facility, such a cutting system comprising equipment such as mentioned above. The hydraulic cutting system comprises among other things a cutting tool, which in the working position is anchored in a pressure tight manner in the pipe in question, and which in the working position is connected to a compressor on the surface facility. The compressor is used to pump pressurised gas, i.e. either compressed air or compressed nitrogen, in immediately below the sealing means of the cutting tool, whereby liquid in this area of the pipe is evacuated via a drain line through the cutting tool. By continuing to pump pressurised gas in under the cutting tool, said liquid will be forced down in the pipe until its surface levels out at the same level as the inlet to the drain line. By so doing, there will exist a small gas filled pipe volume between said sealing means and the inlet to the drain line, this pipe volume also comprising the cutting site in question. Even though said constructional features and steps of action are included by prior art, they are prerequisites for the implementation of the present invention.

According to prior art said drain line through the cutting tool consists of a short drain pipe, the upper end of which is terminated immediately above the cutting tool, while its lower end is terminated just below the cutting depth in question. As mentioned, this leads to gas bubbles rising through the liquid column of the pipe, and such gas bubbles may have a disruptive or damaging effect on the result of the hydraulic cutting. Use of such a short drain pipe also cause the cutting to be carried out at a marginal gas overpressure, allowing the inherent energy of the cutting jet to be reduced through impact losses.

However the present device for a cutting tool is characterized in that said drain line extends further up to the surface facility, where the upper end portion of the drain line is connected to at least one adjustable fluid choke device, e.g. a choke valve. Liquid and/or pressurised gas will thereby flow up to the surface through the drain line instead of rising through the liquid column of the pipe. Controlling the gas feed rate to said compressor and/or controlling the fluid outflow rate through the choke device(s) of the drain line, will at least allow the pressure of said gas filled pipe volume to be controlled. By so doing, the pipe volume may be set at a significantly higher gas overpressure than said marginal gas overpressure used according to prior art, as this gas overpressure must be seen in relation to the greatest hydrostatic pressure that exists immediately outside the pipe/pipes. Such hydrostatic pressure may be created by the hydrostatic pressure of the ground formation or by the hydrostatic pressure in the annulus/annuli surrounding the pipe/pipes. When cutting compound pipes and possibly annular cement, said gas overpressure may optionally be increased further. When a cutting jet passes through such increased gas overpressure and cuts through one or more pipes, overpressurised gas will flow out through the cut(s) and force incoming liquid away from the cut(s) in the pipe/pipes, which minimises the liquid seepage towards and through the cut(s).

Liquid that is introduced to said pipe volume from the cutting jet or via seepage of liquid, will as a result of the elevated gas overpressure, be drained continuously to the surface facility via said drain line. Consequently, fluids carried out by the drain line may, depending on the rate of liquid admission and the gas overpressure in this pipe volume, consist of liquid, liquid mixed in with pressurised gas or only pressurised gas. During the cutting however, there must be interaction between the gas feed rate and the fluid outflow rate. This interaction may be monitored and controlled by means of suitable devices and equipment associated with the surface facility and/or the cutting tool. Conveniently, the interaction is arranged by connecting the upper end portion of said drain line to at least one pressure gauge, a knock-out drum designed with at least one fluid choke device, and possibly also at least one flow meter, and similar equipment for control, treatment and monitoring of the outflowing fluids. As an option, the cutting tool may also be associated with at least one pressure gauge that measures the gas pressure in said pipe volume during the cutting. Moreover, the drain line may be provided with at least one liquid level indicator that measures the level of said liquid surface below the cutting tool and with respect to a specific point of reference, e.g. relative to the inlet to the drain line. By so doing, the extent of said pipe volume may be determined continuously during the cutting.

By using a device according to the invention it is avoided that gas bubbles rising through the liquid column of the pipe and causing any disruptive or damaging movement of the hydraulic cutting tool, which would have a negative effect on the result of the hydraulic cutting.

Moreover, use of the present device allows a small pipe volume under the cutting tool to be filled, in a controlled manner, with gas at a significantly higher pressure than the hydrostatic pressure at the cutting site in question. Consequently, an optimal share of the initial pressure energy of the abrasive fluid will be transmitted to the pipe wall in the form of an impact force, so as to provide quick and efficient cutting of the pipe wall and any additional pipes located outside of this. As a result, optimal operating conditions are provided, which increase the likelihood of achieving efficient and successful hydraulic cuts, and also reduce the operational costs considerably relative to known methods of cutting.

The invention also means that hydraulic cutting may be carried out at considerably greater water depths than those which are common with known cutting techniques. In practice, this means that such cutting may be carried out at water depths exceeding 100 metres.

BRIEF DESCRIPTION OF THE DRAWINGS

In the following description and with reference to the appended drawings, each reference number will refer to the same detail in all drawings in which the detail is shown, where.

Said figures only show those technical details that directly concern the invention and the understanding of this. In addition, all the drawings are simplified and distorted with regard to technical details and relative dimensions.

DETAILED DESCRIPTION

The following examples concerns hydraulic cutting of the casing of a well beneath a water floor in connection with permanent plugging and abandonment of the well.

Figure 1:
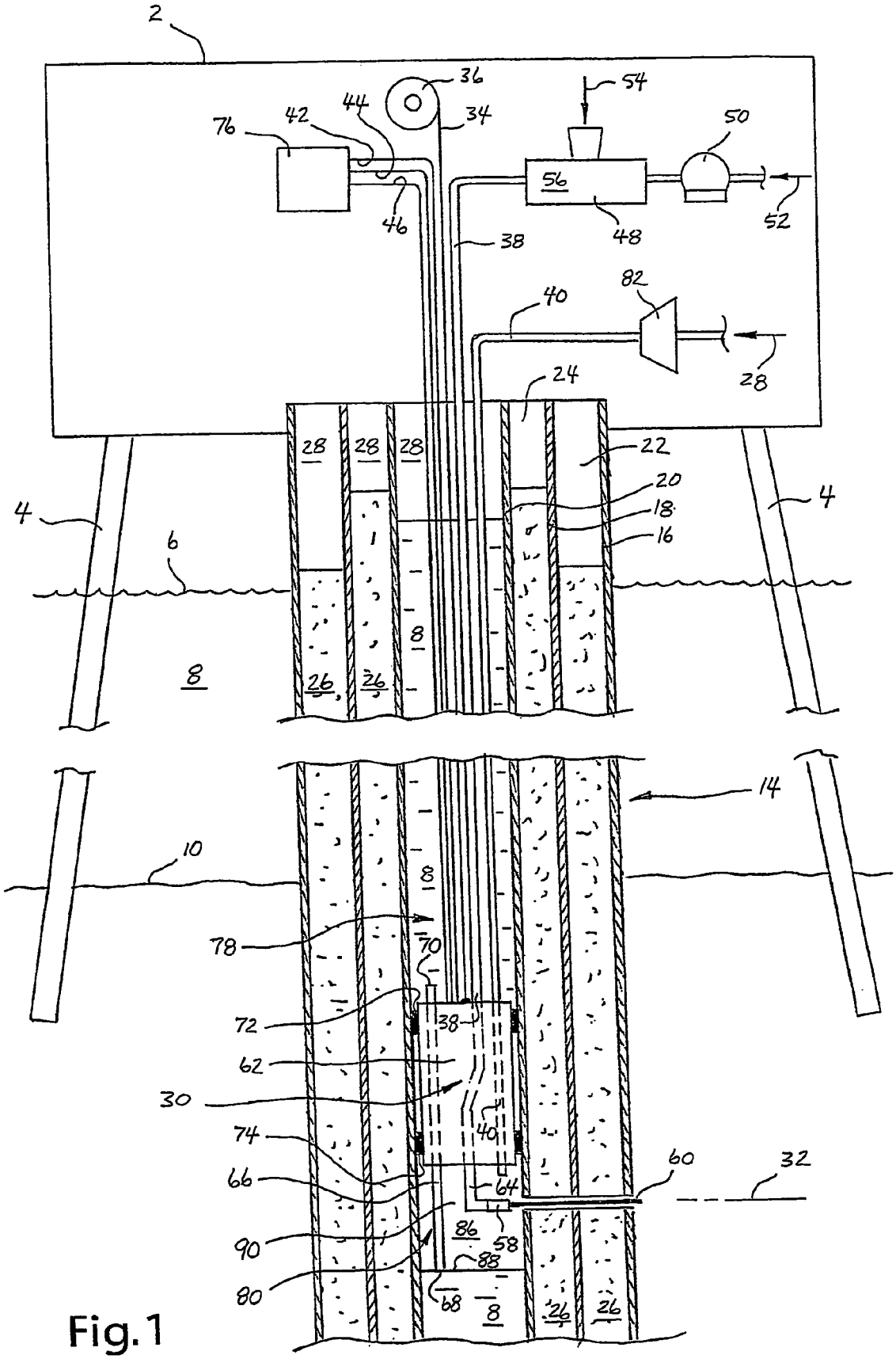
FIG. 1 is a schematic view of an offshore platform installed on a sea floor, which platform is associated with a well in which hydraulic cutting of the casing of the well is carried out according to previously known techniques.
Figure 2:
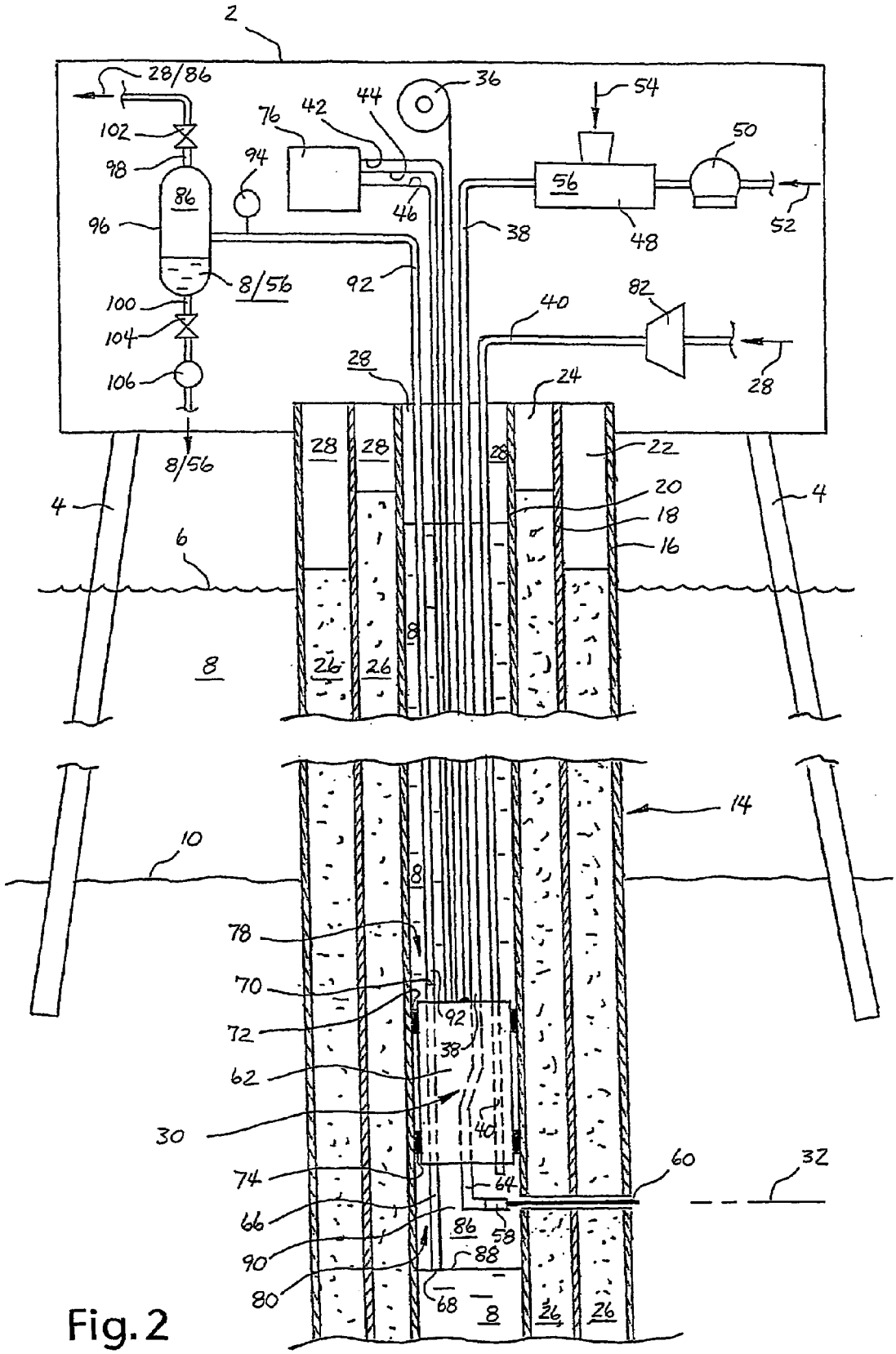
FIG. 2 is a schematic view in which hydraulic cutting of the casing of the well is carried out by using the present invention in combination with the hydraulic cutting technique illustrated in FIG. 1.

FIG. 1 and FIG. 2 show an offshore platform 2 installed on the sea floor, which platform is equipped with platform legs 4, and which is arranged over a surface 6 of the sea. The platform legs 4 extend through seawater 8 down to a sea floor 10 where they penetrate an underlying ground formation 12. An offshore well 14 is formed in the ground formation 12 and extends up to the platform 2. Such a platform 2 will normally be tied in to more offshore wells 14, but the figures and the following discussion are simplified by referring only to one offshore well 14.

Before the well 14 is permanently abandoned, all removable equipment is removed from the well 14, including the wellhead and all or parts of the production tubing. After that, the well 14 consists only of casing strings that are permanently placed in the ground formation 12, and which project above the sea floor 10. These are the casing strings that are cut immediately below the sea floor 10, and where the cut off casing parts are then removed from the sea floor 10. Such casing strings are hereinafter just termed casings.

In the figures, the well 14 consists of several casings placed inside each other and extending deeper into the ground formation 12 with successively decreasing pipe diameters. In the examples, the pipe assembly consists of a conductor casing 16 (outermost), a surface casing 18 and an inner casing 20. The inner casing 20 may for instance be a so-called intermediate casing. In addition, annulus 22 and annulus 24 between said casings are filled with set cement 26 that binds the pipes together, and which forms a pressure barrier against any underlying reservoir fluids. Moreover, the inner casing 20 is provided with various deeper well plugs (not shown in the figures). In the figures, annuli 22, 24 are shown as being filled with cement 26 up to just under the platform 2, while the inner casing 20 is filled with seawater 8 nearly up to the platform 2. Above the cement 26 and the seawater 8 there is atmospheric air 28.

To begin with, a hydraulic cutting tool 30 that is known per se is lowered to a cutting depth 32 in the inner casing 20. The cutting depth 32 will normally be approximately 5 metres below the sea floor 10. The cutting tool 30 is lowered on a cable 34 coupled to a winch 36 on the platform 2. When lowered into the well 14, the cutting tool 30 is also connected to the platform 2 via a high pressure line 38, a compressed air line 40, two hydraulic lines 42 and 44, and also a monitoring cable 46 for electronic monitoring of the hydraulic cutting. The cutting tool 30 is shown in the working position in both FIG. 1 and FIG. 2.

According to prior art, the high pressure line 38 is connected to a mixing tank 48 and an upstream high pressure pump 50 on the platform 2. Water 52 is pumped from the pump 50 into the mixing tank 48, and in the mixing tank 48 the water 52 is mixed with an abrasive 54 to form an abrasive fluid 56. Then the abrasive fluid 56 is pumped down through the high pressure line 38, through the cutting tool 30 and out through a high pressure nozzle 58 provided for this. The abrasive fluid 56 exits at a very high speed and forms a cutting jet 60 that cuts through the casings 16, 18, 20 and said annular cement 26.

In principle, and with reference to FIG. 1, the known cutting tool 30 consists of a body 62 with an outer diameter that fits into the inner casing 20; an angular high pressure pipe 64 that projects down from the body 62 when in the working position, and which is connected by its free end to said high pressure nozzle 58; as well as a short drain pipe 66 extending through the body 62. In the working position the inlet 68 to the drain pipe 66 is arranged at a deeper position than said cutting depth 32, while the outlet 70 of the drain pipe 66 is arranged immediately above the cutting tool 30. The body 62 is also equipped with other known equipment that is not shown in the appended drawings. This equipment includes among other things a hydraulic rotating motor and related equipment used during the cutting to rotate the high pressure pipe 64 and the drain pipe 66 through at least one complete rotation about the axis of the inner casing 20. Said equipment (not shown) also comprises an actuator device for fixing the cutting tool 30 against the pipe wall of the inner casing 20 in a releasable and pressure tight manner, together with necessary piping, couplings, gaskets and similar connecting means. The actuator device comprises hydraulic cylinders and pistons that upon activation are forced axially against rubber elastic packing elements 72 and 74 in the outer wall of the body 62, whereby the elements 72, 74 expand against the inner casing 20 in a pressure tight manner. Said rotating motor and actuator device (not shown) are driven by means of hydraulic fluid supplied via said two hydraulic lines 42, 44, the lines 42, 44 being connected to at least one hydraulic power and control unit 76 on the platform 2. Also, the body 62 is a unit that is connected to associated external equipment in a pressure tight manner. In the working position, the cutting tool 30 thereby forms a pressure tight barrier between an overlying section 78 and an underlying section 80 of the inner casing 20, and consequently said short drain pipe 66 represents the only hydraulic connection between the pipe sections 78, 80.

Moreover, the upper end of said compressed air line 40 is connected to an air compressor 82 on the platform 2. The compressed air line 40 extends through the body 62 and terminates at a lower outlet 84 located immediately below the body 62. By using the compressor 82, and after the cutting tool 30 has been anchored in the working position in the inner casing 20, pressurised air 86 is continuously pumped out through the outlet 84 of the compressed air line 40. Seawater 28 in the underlying pipe section 80 will then be evacuated through the short drain pipe 66, whereby the water 28 will flow out through the outlet 70 of the drain pipe 66 immediately above the cutting tool 30. The liquid outflow will continue until its liquid surface 88 in the underlying pipe section 80 has been forced down to the inlet 68 to the drain pipe 66. After that the outflow will mainly consist of compressed air 86, or of compressed air 86 mixed in with seeping seawater 28 and/or abrasive fluid 56. Therefore, during the cutting operation there will exist an air filled pipe volume 90 between the packing elements 72, 74 and the liquid surface 88. This drain pipe arrangement will however mean that the air pressure in the pipe volume 90 can not exceed the greatest hydrostatic pressure that exists either at the outlet 70 of said drain pipe 66, in said annuli 22, 24 or in the surrounding ground formation 12, to any appreciable extent. As mentioned previously, hydraulic cutting at such a marginal air overpressure will negatively affect the result of the cutting.

In the following, and with reference to FIG. 2, reference will be made to an embodiment of the present invention. With the exception of said short drain pipe 66, the following embodiment comprises among other things the same equipment as that mentioned in the preceding and known embodiment, including said rotating motor, setting device, compressed air means and casing assembly 16, 18, 20. FIG. 2 also shows that cutting tool 30 in the working position, the cutting jet 60 passing through an air filled pipe volume 90 and cutting through said casings 16, 18 and 20 and cement 26.

According to the invention, the cutting tool 30 is also connected to the platform 2 via a drain hose 92. The lower (upstream) end of the drain hose 92 is connected to the short drain pipe 66 of the body 62, and the upper (downstream) end of the drain hose 92 is connected to a pressure gauge 94 and an adjustable choke device on the platform 2. The choke device comprises a knock-out drum 96 to which is connected an air outlet pipe 98 and a liquid outlet pipe 100. The air outlet pipe 98 is equipped with an air choke valve 102, while the liquid outlet pipe 100 is equipped with a liquid choke valve 104 and a liquid flow meter 106. Fluids (liquid 8, 56 and/or compressed air 86) that are drained from said pipe volume 90 via the drain pipe 66 and the drain hose 92 during the hydraulic cutting, will be separated into two branch flows in the knock-out drum 96, of which one air branch flow exits through the air outlet pipe 98 and one liquid branch flow exits through the liquid outlet pipe 100.

As mentioned, the invention makes it possible to carry out hydraulic cutting at an elevated air overpressure in said pipe volume 90. This air overpressure may be set at an appropriate pressure level through interaction between the air feed rate and the air outflow rate. The interaction is implemented through control of the air feed rate from the air compressor 82 and/or by choking the air outflow rate through the air choke valve 102 in the air outflow pipe 98. The air pressure in the pipe volume 90 is measured by means of said pressure gauge 94.

In addition, the level of the liquid surface 88 in the pipe volume 90 may be controlled through interaction between the air pressure in the pipe volume 90 and the liquid outflow rate therefrom. The liquid outflow rate is controlled at the downstream end by means of said liquid choke valve 104 provided in the liquid outflow pipe 100. This outflow rate is measured by means of said liquid flow meter 106.

By monitoring the types of fluid that flow out via the drain hose 92, it is possible to obtain an indication of where in the inner casing section 80 the liquid surface 88 is located, in relation to the inlet 68 to said drain pipe 66. A discharge consisting only of liquid, e.g. seawater 8 and/or abrasive fluid 56, indicates that the liquid surface 88 is located at a shallower level than said inlet 68. A discharge comprising a mixture of said liquid and compressed air 86 indicates that the liquid surface 88 is located at approximately the same level as the inlet 68. A discharge consisting only of compressed air 86 indicates that the liquid surface is located at a deeper level than the inlet 68, which condition complicates the measurement of the volume of liquid drained.

Ideally, the liquid surface 88 should be at the same level as the inlet 68. With this, the drained liquid volume may be measured at any time, which volume also indicates how much liquid 8, 56 is being introduced to the pipe volume 90 at any time during the cutting. Based on information regarding air pressure, outflow rate and type of fluid, it is possible to e.g. control the air pressure in the pipe volume 90 and/or the level of the liquid surface 88 in the inner casing section 80. By so doing, it becomes possible to provide optimal operating conditions during the cutting operation, which increases the likelihood of achieving efficient and successful hydraulic cuts. Said changes are made possible by using the present invention.

The invention claimed is:

1. A device for a hydraulic cutting tool for cutting at least one pipe beneath a water floor, the at least one pipe being disposed in a ground formation, wherein hydraulic cutting is carried out from a surface facility equipped with at least the following auxiliary equipment:

(a) a hoisting device for hoisting the cutting tool down to or up from a cutting depth in the pipe;

(b) a high pressure pump for pumping an abrasive fluid from an associated mixing tank;

(c) a compressor for pumping pressurised gas; and (d) at least one power and control unit for supplying power to and controlling a releasable setting device and a rotating motor in the cutting tool;

wherein the cutting tool is made up of:

(e) a body fitted with at least the following equipment:

(f) said releasable setting device for pressure tight setting of the cutting tool in the pipe, whereby the pipe is divided into an overlying pipe section and an underlying pipe section;

(g) a rotatable high pressure pipe, the free end of which is connected to a high pressure nozzle from which said abrasive fluid exits in the form of a cutting jet during the cutting, the high pressure pipe projecting down from the body when in the working position;

(h) said rotating motor for pipe peripheral rotation of the high pressure pipe and the high pressure nozzle during the cutting; and (i) a short drain line extending axially through the cutting tool, the inlet to which, in the working position, is arranged deeper than the high pressure nozzle, while its outlet is arranged immediately above the body, the short drain line thereby forming the only hydraulic connection between said pipe sections of the pipe;

wherein said equipment at the cutting tool is connected to said auxiliary equipment on the surface facility via the following connecting lines:

(j) a hoisting cable between the cutting tool and the hoisting device;

(k) a high pressure line between the high pressure pipe and the mixing tank;

(l) a pressure line for gas leading from said underlying pipe section axially through the body and up to the compressor; and (m) at least one auxiliary line for power supply to, control and/or monitoring of equipment in the cutting tool;

and where, after the cutting tool has been set but before the cutting is initiated, pressurised gas is pumped continuously through the pressure line and into the underlying pipe section, whereby liquid is evacuated through the short drain line and the surface of the liquid is forced down to the inlet to the drain line, so as to create a gas filled pipe volume comprising said cutting depth between the body and said inlet, whereupon the hydraulic cutting is initiated by continuously pumping abrasive fluid through said high pressure line while rotating the high pressure pipe and the high pressure nozzle, wherein the outlet of said short drain line is connected to a second drain line extending up to the surface facility, the upper end portion of which drain line is connected to at least one adjustable choke device, allowing the gas overpressure in said pipe volume to be controlled during the cutting in order to achieve optimal cutting conditions.

2. A device in accordance with claim 1, wherein a upper end portion of the second drain line is connected to at least one pressure gauge.

3. A device in accordance with claim 1, wherein the cutting tool is associated with at least one pressure gauge measuring the gas pressure in said pipe volume.

4. A device in accordance with claim 2, wherein the cutting tool is associated with at least one pressure gauge measuring the gas pressure in said pipe volume.

5. A device in accordance with claim 1, wherein the cutting tool is associated with a liquid level indicator that measures the level of the liquid surface below the cutting tool, whereby the extent of said pipe volume may be determined continuously during the cutting.

6. A device in accordance with claim 2, wherein the cutting tool is associated with a liquid level indicator that measures the level of the liquid surface below the cutting tool, whereby the extent of said pipe volume may be determined continuously during the cutting.

7. A device in accordance with claim 3, wherein the cutting tool is associated with a liquid level indicator that measures the level of the liquid surface below the cutting tool, whereby the extent of said pipe volume may be determined continuously during the cutting.

8. A device in accordance with claim 1, wherein said at least one adjustable choke device is constituted by a knock-out drum to which the drain line is connected, the knock-out drum being connected at its downstream side to a separate gas outlet pipe with a gas choke valve and a separate liquid outlet pipe with a liquid choke valve.

9. A device in accordance with claim 8, wherein the liquid outlet pipe is equipped with at least one liquid flow meter.

* * * * *